United States Patent [19]

Boroson

[11] Patent Number: 4,625,784

[45] Date of Patent: Dec. 2, 1986

[54] INDOOR AIR CONDITIONER COVER AND SYSTEM

[76] Inventor: Bernard A. Boroson, 101 Clark St., Brooklyn, N.Y. 11201

[21] Appl. No.: 744,105

[22] Filed: Jun. 12, 1985

[51] Int. Cl.[4] ..... A47B 81/00

[52] U.S. Cl. ..... 150/52 R; 206/320

[58] Field of Search ..... 150/52 R; 383/2; 206/320

[56] References Cited

U.S. PATENT DOCUMENTS

| | | | |
|---|---|---|---|
| 1,330,345 | 2/1920 | Randolf | 150/52 R |
| 2,705,990 | 4/1955 | Miller | 150/52 R |
| 2,711,769 | 6/1955 | Katcher et al. | 150/52 R |
| 2,720,236 | 10/1955 | Hoffman | 150/52 R |
| 2,992,668 | 7/1961 | Collard | 150/52 R |
| 3,002,236 | 10/1961 | Humphner | 150/52 R X |
| 3,320,996 | 5/1967 | Singer | 150/52 R |
| 4,202,389 | 5/1980 | Ewald | 150/52 R |
| 4,308,905 | 1/1982 | Gallagher | 150/52 R |
| 4,325,229 | 4/1982 | Dezurik | 150/52 R X |

*Primary Examiner*—William Price
*Assistant Examiner*—Sue A. Weaver
*Attorney, Agent, or Firm*—Auslander & Thomas

[57] ABSTRACT

A modular fabric indoor air conditioner cover set prevents cooling of a room from outside air in a room air conditioner and the loss of heat through the air conditioner. The cover has an opening the periphery of which can grasp the periphery of the indoor portion of an air conditioner. The indoor air conditioner cover is modular in periphery and includes a releasable fold adapted to expand the depth of the cover, thus the cover set with a plastic sheet sealed to the indoor face of the air conditioner provided an effective set for fitting a large variety of different air conditioners and for protecting against unwanted cold.

7 Claims, 4 Drawing Figures

FIG.1
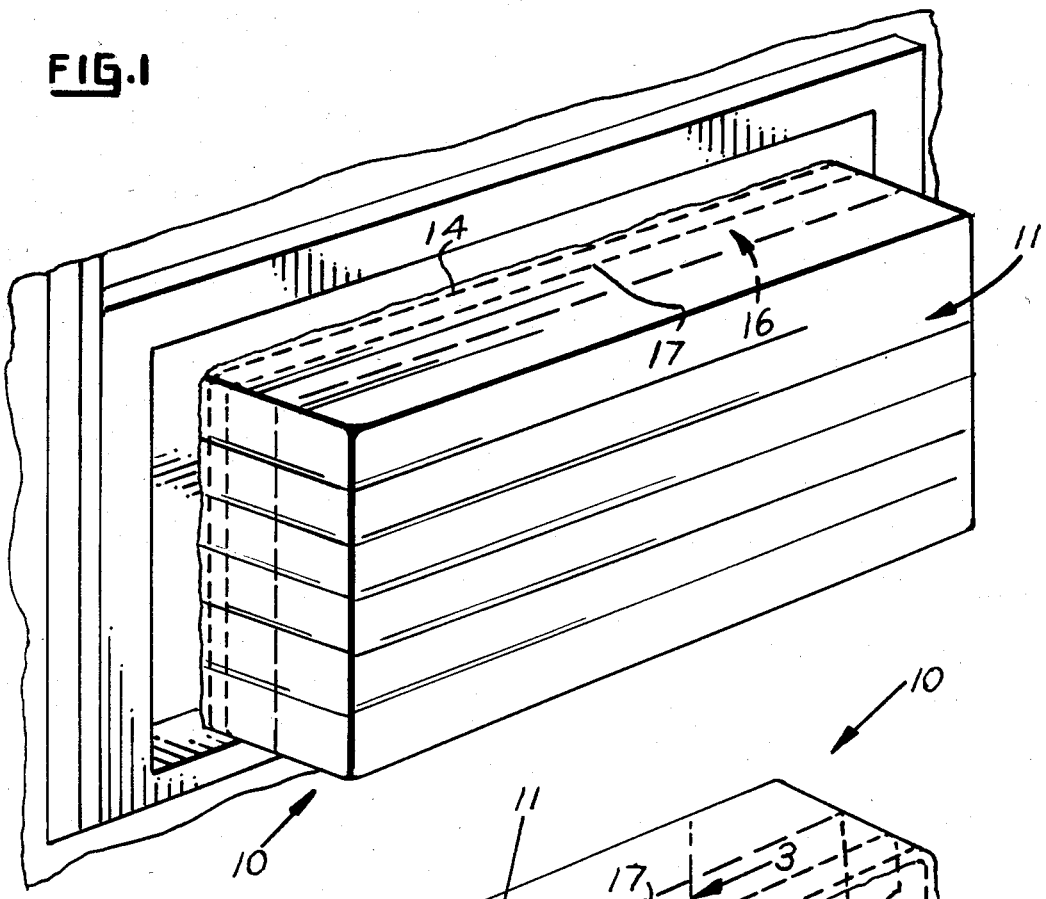
FIG.2
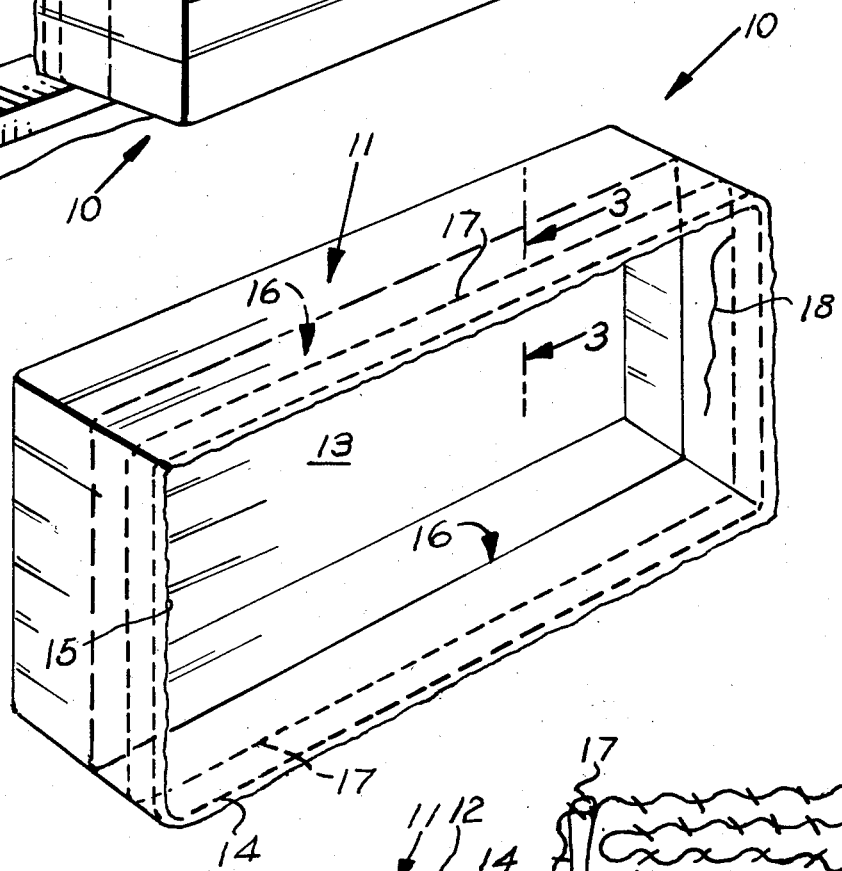
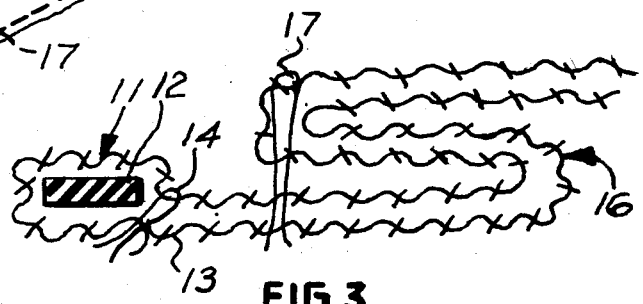
FIG.3

INDOOR AIR CONDITIONER COVER AND SYSTEM

The present invention relates to a modular indoor air conditioner cover and cover system adapted to fit different size air conditioners, with different projections into a room, and which functions to prevent cold air from infiltrating a room.

Particularly, during winter in high rise apartments, high winds and cold oftentimes infiltrate through outdoor air conditioner covers which have been provided to cover the outside extending portion of the air conditioner. Such covers have usually been concerned primarily with the windproofing and waterproofing of the air conditioner. Outside covers of the past are oftentimes dangerous, difficult or impossible to install, either from the inside or the outside of a building, particularly a high rise building, and the outside cover was subjected to the full impact of the elements.

In the prior art, air conditioner covers or cover systems such as disclosed in U.S. Pat. No. 4,308,905, have been primarily directed to the problems of covering the outside of an air conditioner. Air conditioner covers such as disclosed in U.S. Pat. No. 4,308,905, when directed to indoor use have not taken into account the particular different considerations and environment of the inside of the house, even though such air conditioner covers may be physically usable indoors and include secondary means to prevent cold air infiltration, nor does the cover of the '905 patent provide for adaptability of the cover module to fit a large assortment of air conditioners. The '905 system simply adapts a clamp length to fit the air conditioner. Typical outdoor air conditioner covers adapted to the particular outdoor environment are exemplified in U.S. Pat. No. 4,202,389, U.S. Pat. No. 2,992,688, U.S. Pat. No. 2,720,236 and U.S. Pat. No. 2,705,990.

The present invention is a modular fabric indoor air conditioner cover and cover set adapted to grasp the indoor portion of a mounted air conditioner. The cover has a fabric outer ply and an inner ply of insulating fibre. The indoor air conditioner cover fits over the indoor portion of an air conditioner. The open end of the cover is adapted to grasp the periphery of the indoor portion of an air conditioner, conform to it and effectively hold the indoor air conditioner cover in place. The cover is effective in a set with an air impermeable plastic sheet and adhesive tape to seal the sheet to the indoor portion of the air conditioner.

The open end of the indoor air conditioner cover has an elastic biased periphery and a stitched peripheral fold. The stitching of the fold is releasable by use of a pullstring. The fold in various models may be of modular depths, thus, more than one module of the indoor air conditioner cover of the present invention may have the same pattern cut for the front to open end length and each module can fit a range of air conditioner faces, sizes and depths. Several modules of different opening size, with different fold depth, can cover many varieties of different air conditioners.

The indoor air conditioner cover and cover set has the advantage of being able to cover the face of the air conditioner, giving an aesthetic aspect to what was formerly just an air conditioner face, yet protecting more effectively against cold air infiltration. The cover also may optionally be in decorator styles of fabric or have an outer ply of decorator fabric (not shown). The indoor air conditioner cover of the present invention is preferably quilted, with the outer ply sewn to the inner ply of insulating fibre.

Taping of the plastic sheet of the air conditioner cover set to the air conditioner from the inside is an effective expedient for maintaining the set air impermeable. By having the tape and plastic sheet on the inside keeps the seal protected from the ravages of weather that might wear out an outside seal. The inner ply insulates the room from any cold air in the air conditioner kept from infiltrating a room by the plastic sheet.

The present invention enables a limited number of sizes of indoor air conditioner covers, in a set, to handle the variety of air conditioner shapes, sizes and projections into a room and reduces the expense of inventorying and manufacturing many sizes of indoor air conditioner covers. Being able to supply indoor air conditioner covers for many air conditioners with modular indoor air conditioner covers has a significant impact in reducing the cost of production of indoor air conditioner cover of the present invention.

Having a modular indoor air conditioner cover also facilitates being able to restock supplies more easily and makes selection of the appropriate cover much easier for the purchaser. The purchaser does not have to sort through many indoor air conditioner covers to find what is needed. The retailer also benefits by having less shelf requirements to be able to supply a larger market.

Although such novel feature or features believed to be characteristic of the invention are pointed out in the claims, the invention and the manner in which it may be carried out, may be further understood by reference to the description following and the accompanying drawings.

FIG. 1 is a perspective view of a cover of the cover set of the present invention engaged on th indoor portion of an air conditioner.

FIG. 2 is a perspective rear view of the cover showing the open end as if exploded away from the air conditioner of FIG. 1.

FIG. 3 is a detail section of FIG. 2 at lines 3—3.

Referring now to the figures in greater detail, where like reference number denote like parts in the various figures.

Figure 4:
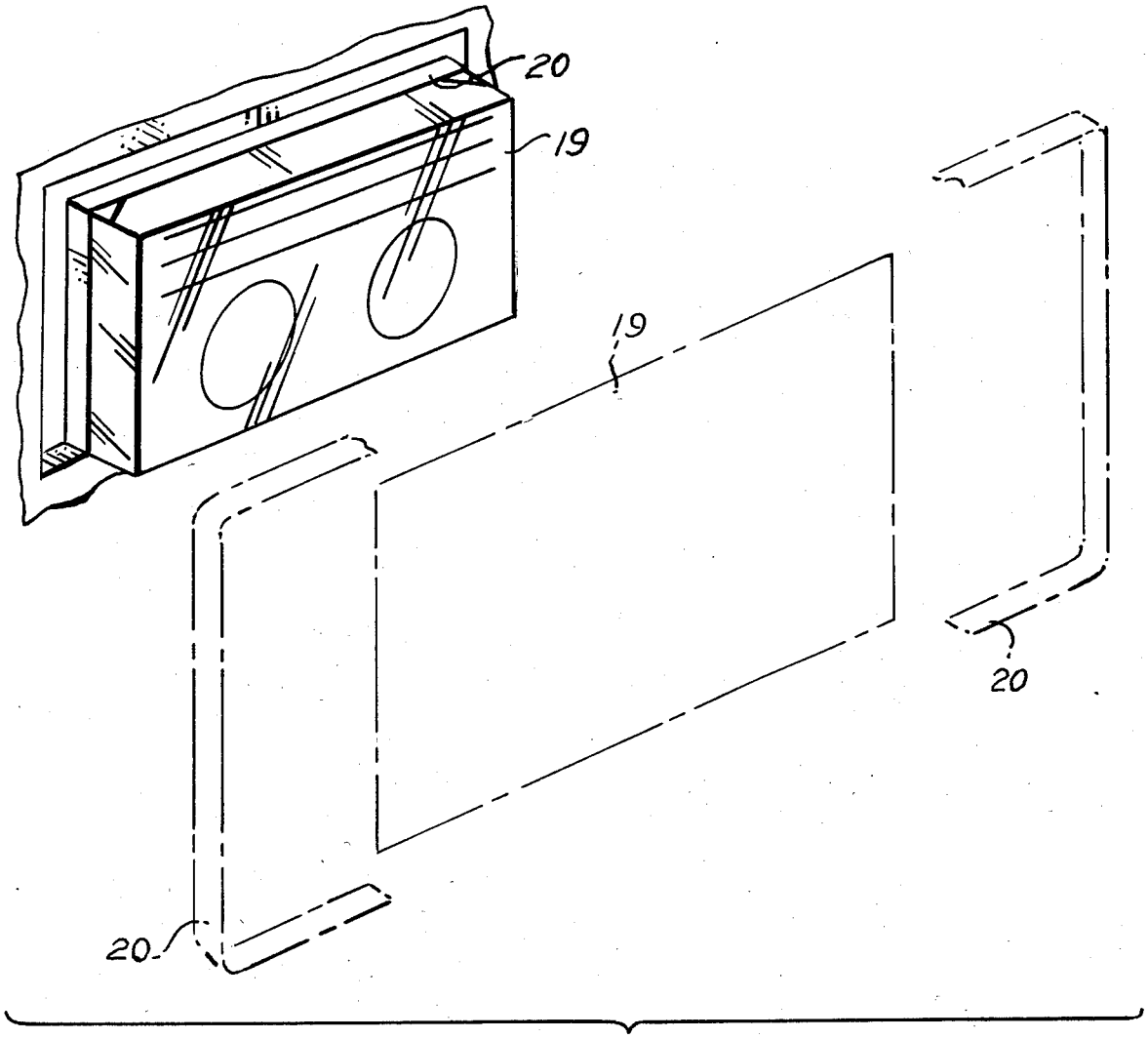
FIG. 4 is a view of an air conditioner face with the plastic sheet and sealing tape exploded away.

As shown in the FIGS. 1-3, the indoor air conditioner cover 10, has an outer ply 11, an inner ply of insulating fibre 13 and an elastic biased open end 15.

The elastic biased open end 15, as shown in FIG. 3 has the outer ply 11 enfolding and an elastic band 12, about which is stitched the outer ply 11. The stitching 14 engages the outer ply 11 and the inner ply of insulating fiber 13. Thus, the elastic biased open end 15 is adapted to size of the periphery of indoor portion of the air conditioner to grasp and conform to it.

The outer ply 11 has the advantage of being adaptable to the aesthetics of room decoration while also functioning to help insulate the room against cold from the air conditioner, as an energy saver. The inner ply of insulating fibre 13 is preferably of polyester ½ to ¾ of an inch thick or some other form of insulator lining.

The indoor air conditioner cover 10 includes a stitched peripheral fold 16. The stitched peripheral fold 16 is of a selected modular depth adapted to optimize the selection of air conditioner that the indoor air conditioner cover 10 will accommodate. Thus, different modules will have different depth folds. As shown in FIGS.

1–3, the stitched peripheral fold 16 is used as is and is without the removal of the stitching 17 to deepen the indoor air conditioner cover 10 from its front face 20 to its elastic biased to open end 15.

As can be seen in FIG. 4 the indoor portion of air conditioner is sealed with a plastic sheeet 19. The plastic sheet 19 is enfolded over the indoor portion of the air conditioner and sealed to it in an air impermeable manner by use of tape 20.

In operation, the plastic sheeet 19 is enfolded about the indoor portion of the air conditioner, then sealed to it, as show in FIG. 4. Cold air seeping into the air conditioner is contained by the plastic sheet 19 held by the tape 20. The indoor air conditioner cover 10 is placed over the sealed inner portion of the air conditioner. Where the depth of the indoor air conditioner cover 10 is inadequate to properly cover the indoor portion of the air conditioner, the pullstring 18 is pulled, opening the stitching 17, allowing the stitched peripheral fold 16 to be released. The pullstring 18 is preferably a chain stitch. The indoor air conditioner cover 10 is then extendable to its selected modular length to accommodate the particular air conditioner. The stitched peripheral fold 16 is preferably 4 or 8 inches in extended depth.

In a preferred embodiment of the cover 10, as shown in FIGS. 2 and 3, the outer ply 11 and inner ply of insulating fiber 13 are quilted. The inner ply of insulating fibre 13 functions to restrict air cooling the room, while the plastic sheet 19 keeps the cold air from entering the room.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invnetion in some detail, what is claimed is:

1. An indoor air conditioner cover set for the indoor portion of and air conditioner comprising means substantially impermeable to air, means to seal said impermeable means to said indoor portion of said air conditioner, a fabric cover, said cover including; a fabric outer layer; an inner ply of insulating fibre; open at one end; and said cover adapted to fit over the indoor portion of an air conditioner, means at said open end of said indoor air conditioner cover adapted to selectively reduce the periphery of said opening, said periphery adapted to grasp the periphery of said indoor portion of said air conditioner over said impermeable means and conform thereto, a peripheral fold in said cover, said peripheral fold including means to optionally release said fold to increase the depth of said cover.

2. The indoor air conditioner cover set of claim 1 wherein said air impermeable means is a plastic sheet, said plastic sheet adapted to enfold the indoor portion of an air conditioner, and wherein said means to seal includes adherable tape.

3. A modular fabric indoor air conditioner cover for the indoor portion of a mounted air conditioner including a fabric outer ply and an inner insulating ply; and an open end adapted to fit over the indoor portion of an air conditioner, means at said open end of said modular indoor air conditioner cover adapted to grasp the periphery of said indoor portion of said air conditioner and conform thereto, and a peripheral fold in said cover, said peripheral fold including means to optionally release said fold to increase the depth of said cover.

4. The modular indoor air conditioner cover of claim 3 wherein said means to grasp the periphery of said air conditioner includes elastic means.

5. The modular indoor air conditioner cover of claim 4 wherein said peripheral fold is stitched.

6. The modular indoor air conditioner cover of claim 5 wherein said fold release means is a pullstring.

7. The modular indoor air conditioner cover of claim 6 wherein said pullstring is a chain stitch.

* * * * *